US006655792B2

(12) United States Patent
Benson et al.

(10) Patent No.: US 6,655,792 B2
(45) Date of Patent: Dec. 2, 2003

(54) GEOMETRIC FEATURES TO MINIMIZE FREE INK IN AN INK SUPPLY FLUID INTERCONNECT

(75) Inventors: David J. Benson, Albany, OR (US); Kevin D. Almen, Albany, OR (US); Michael S. Ardito, Lebanon, OR (US); Ralph W. Kinser, Jr., Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/919,557

(22) Filed: Jul. 31, 2001

(65) Prior Publication Data

US 2003/0025774 A1 Feb. 6, 2003

(51) Int. Cl.[7] ..... B41J 2/145
(52) U.S. Cl. ..... 347/86
(58) Field of Search ..... 347/84, 85, 86, 347/87

(56) References Cited

U.S. PATENT DOCUMENTS

| | | | | | |
|---|---|---|---|---|---|
| 5,517,220 A | | 5/1996 | English | ..... | 347/29 |
| 5,790,158 A | * | 8/1998 | Shinada et al. | ..... | 347/86 |
| 6,123,409 A | | 9/2000 | Wolf | ..... | 347/33 |

FOREIGN PATENT DOCUMENTS

| | | | | | |
|---|---|---|---|---|---|
| JP | 09226142 A | * | 9/1997 | ..... | B41J/2/175 |

* cited by examiner

*Primary Examiner*—Anh T. N. Vo
(74) *Attorney, Agent, or Firm*—Larry Baker

(57) ABSTRACT

Embodiments of the present invention comprise geometric features in the fluid interconnect region of an ink container which inhibit residual ink from contacting a removable seal on the container or the fingers and clothing of the container installer. The features comprise a fluid accumulator and capillary break.

20 Claims, 6 Drawing Sheets

GEOMETRIC FEATURES TO MINIMIZE FREE INK IN AN INK SUPPLY FLUID INTERCONNECT

The present invention relates generally to printing systems, and more particularly to features to prevent residual ink from coming in contact a printer operator upon installation or removal of an ink container.

BACKGROUND OF THE INVENTION

Ink jet printers are well known in the art. The most common type of ink jet printer uses thermal excitation of the ink to eject droplets through tiny nozzles, or orifices, onto a print media. Other ink jet mechanisms, such as the use of piezoelectric transducers or wave propagation as ink droplet generators, are also well understood. With all ink jet technologies, the ink jet pen is typically mounted on a carriage which is scanned across the print media; dot matrix manipulation of the droplets provides alphanumeric character and graphics printing capabilities. To provide a color printing capability, pens for each primary color (cyan, magenta, and yellow) are commonly used, typically in addition to black.

The ink jet pen itself may have a self-contained reservoir for storing ink and providing appropriate amounts of ink to the printhead during a printing cycle. These self-contained pens are commonly referred to in the art as print cartridges. If a reusable, semi-permanent pen rather than a print cartridge is employed, ink is either supplied from a remote, off-axis (or off-board), ink reservoir, or the ink reservoir is mounted on the carriage with the pen.

In a typical ink jet printing system with semi-permanent pens and replaceable ink supplies, the replacement ink supplies are generally provided with seals over the fluid interconnects to prevent contamination of the interconnects during distribution and storage. One common sealing method is the use of a removable sealing tape or label. A common problem with the use of sealing tape on fluid interconnects is that the side of tape in contact with the container may become contaminated with residual ink from the fluid interconnect. When the sealing tape is removed for installation of the ink supply into the printer, the residual ink may contact the fingers or clothing of the installer. Great care must therefore be exercised when removing the sealing tape to avoid contact with residual ink.

Residual ink in the fluid interconnect region of a container can also interact with the adhesives used to retain the sealing tape to the container. This interaction can affect the characteristics of the ink in the container, degrading print quality.

There is therefore a need for features which prevent residual ink in the fluid interconnect region of an ink container from contacting the removable seal on the container or the fingers or clothing of the installer.

SUMMARY OF THE INVENTION

Embodiments of the present invention comprise geometric features in the fluid interconnect region of an ink container which inhibit residual ink from contacting a removable seal on the container or the fingers and clothing of the container installer.

Other aspects and advantages of the present invention will become apparent from the following detailed description, taken in conjunction with the accompanying drawings, illustrating by way of example the principles of the invention.

DESCRIPTION OF THE PREFERRED EMBODIMENT

The present invention contemplates changing the geometry of the fluidic interconnect of a replacement ink container such that any residual ink from ink fill can be kept or drawn away from the sealing member placed over the fluid interconnect. As discussed below, the preferred embodiment of the invention utilizes a capillary fluid accumulator (chamfer) and a capillary break. The capillary accumulator provides a strong capillary force to hold the ink in contact with the foam reservoir of the container, keeping it away from the seal or removable label. The capillary break minimizes ink in the fluid interconnect region by holding it at a corner (a high capillarity region) and also acts as an accumulator for any ink that does get into the fluid interconnect region.

Figure 1:
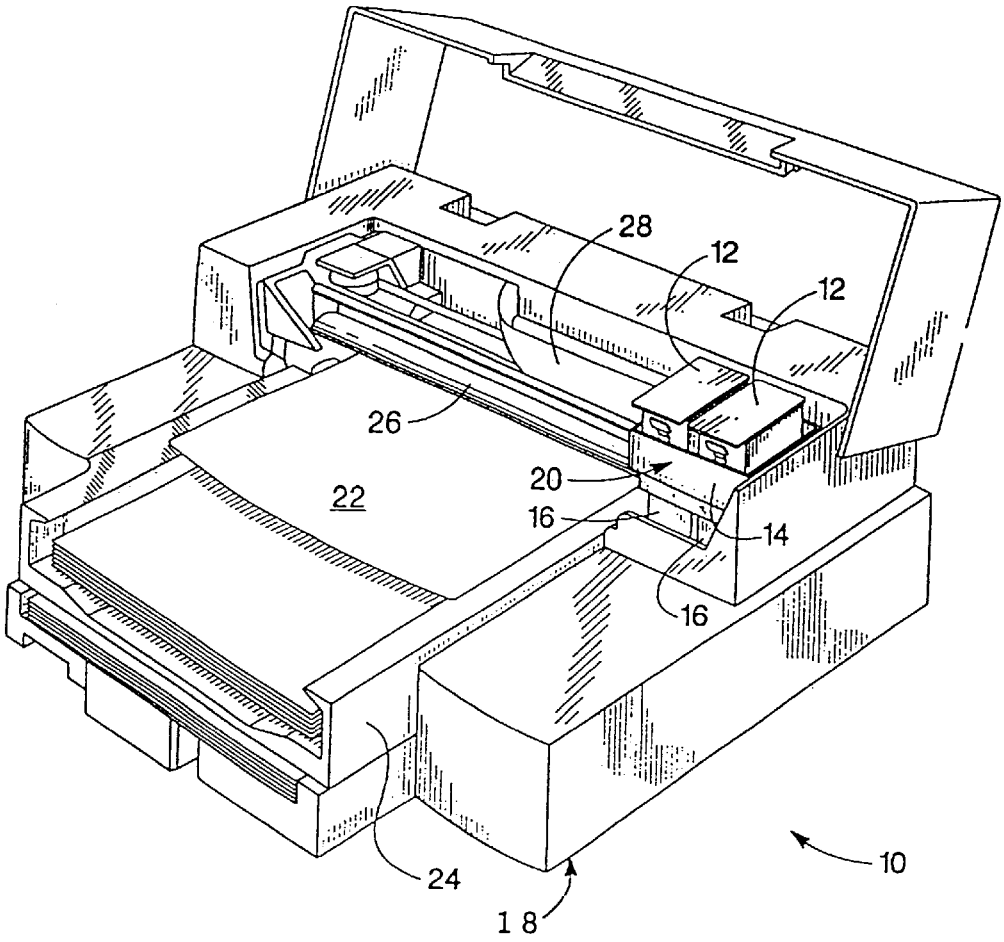
FIG. 1 is a perspective view of an exemplary ink jet printing system in which ink containers incorporating the geometric features of the present invention may be incorporated.

FIG. 1 is a perspective view of a typical printing system 10 shown with its cover open, that includes a plurality of replaceable ink containers 12 that are installed in a receiving station 14. With the replaceable ink containers 12 properly installed into the receiving portion 14, ink is provided from the replaceable ink containers 12 through a manifold (not visible in this view) to inkjet printheads 16. The inkjet printheads 16 are responsive to activation signals from a printer portion 18 to deposit ink on print media. As ink is ejected from the printheads 16, the printheads 16 are replenished with ink from the ink containers 12. The ink containers 12, receiving station 14, and inkjet printheads 16 are each part of a scanning carriage that is moved relative to a print media 22 to accomplish printing. The printer portion 18 includes a media tray for receiving the print media 22. As the print media 22 is stepped through a print zone, the scanning carriage 20 moves the printheads 16 relative to the print media 22. The printer portion 18 selectively activates the printheads 16 to deposit ink on print media 22 to thereby accomplish printing.

The scanning carriage 20 is moved through the print zone on a scanning mechanism which includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printheads 16 by means of an electrical link such as a ribbon cable 28.

The ink receiving station 14 (including the manifold) is in fluid communication with the printheads 16 for providing ink to the printheads.

Figure 2:
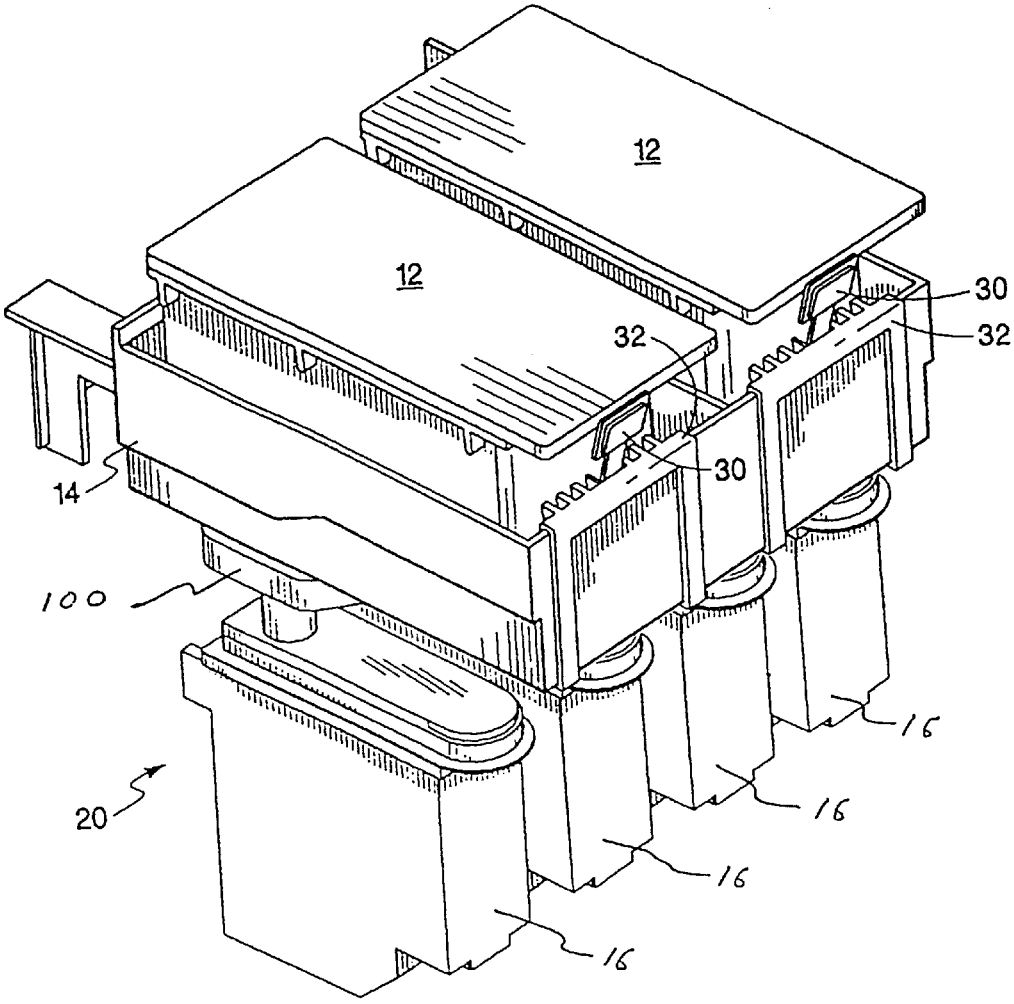
FIG. 2 is an enlarged perspective view of a portion of a scanning carriage of an exemplary ink jet printing system.

FIG. 2 is a perspective view of a portion of the scanning carriage 20 showing a pair of replaceable ink containers 12, typically one for black ink and one for color ink, properly installed in the receiving station 14. Attached to the base of the receiving station is a manifold 100. Inkjet printheads 16 are in fluid communication with the receiving station 14 through the manifold. In the embodiment illustrated, the inkjet printing system 10 shown in FIG. 1 includes a tri-color ink container containing three separate ink colors (cyan, magenta, and yellow) and a second ink container containing a single ink color. The replaceable ink containers 12 can be partitioned differently to contain fewer than three ink colors or more than three ink colors if more are required. For example, in the case of high fidelity printing, frequently six or more colors are used to accomplish printing.

Figure 3:
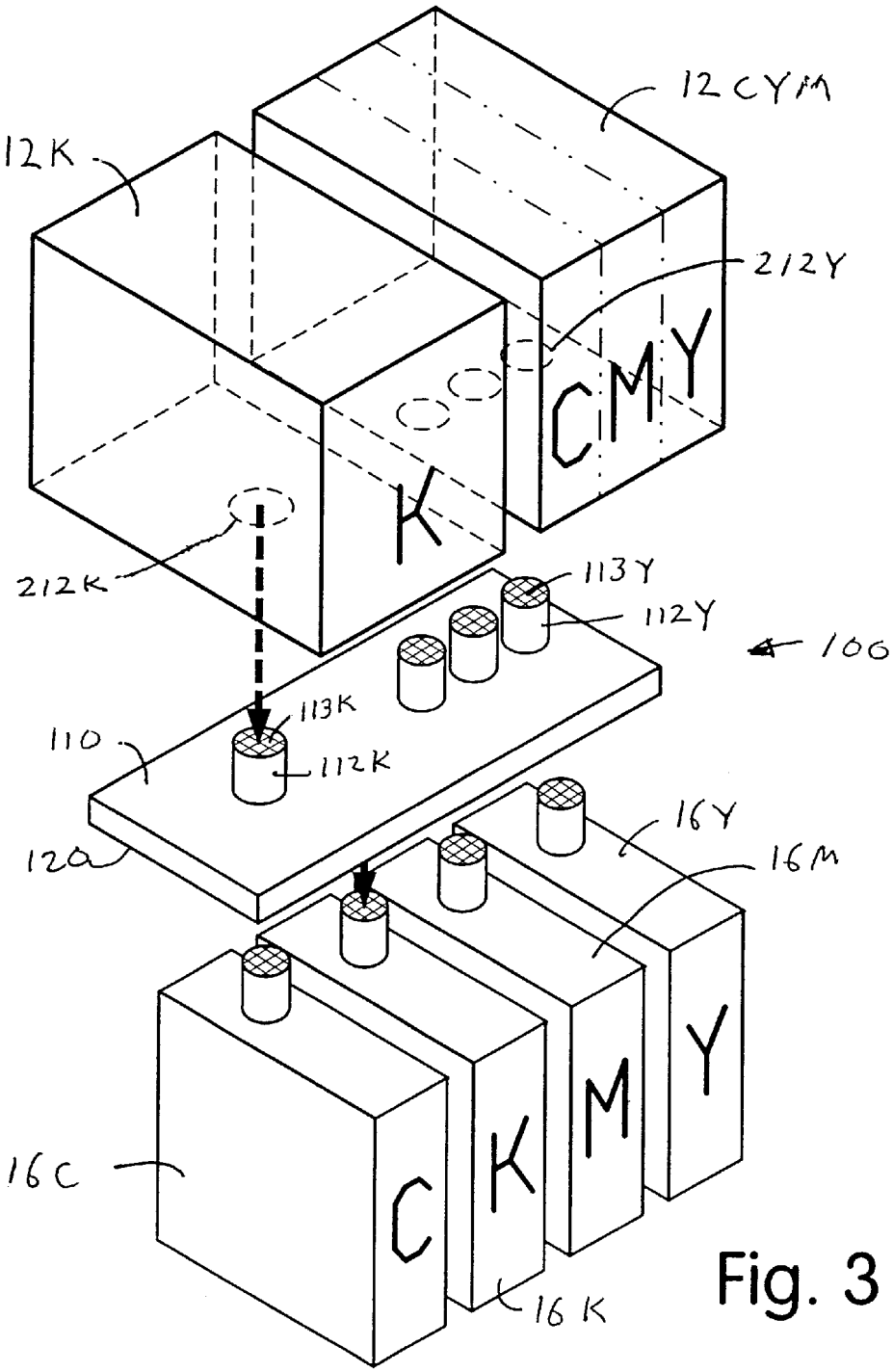
FIG. 3 is a simplified representation of the ink supplies, coupling manifold, and printheads of an exemplary ink jet printing system.

FIG. 3 is a simplified diagram further illustrating an exemplary ink delivery system (for clarity, the supporting structure of the receiving station is omitted). The specific configuration of ink reservoirs and printheads illustrated in FIG. 3 is one of many possible configurations. The manifold 100 comprises an upper "supply" plate 110 and lower "pen" plate 120. Towers on the upper "supply" plate, as exemplified by 112K and 112Y, engage the fluid interconnects 212K, 212Y of the replaceable ink supplies, as exemplified by 212K and 212Y. The towers include mesh filters 113K, 113Y at their tops which contact the foam with the ink containers (not shown) to establish a fluid interconnect. Internal channels within the manifold (not shown) route the various ink colors to the appropriate printheads 16B, 16C, 16M, and 16Y (for illustrative purposes the path followed by the black ink is illustrated with a thick dashed line).

Figure 4:
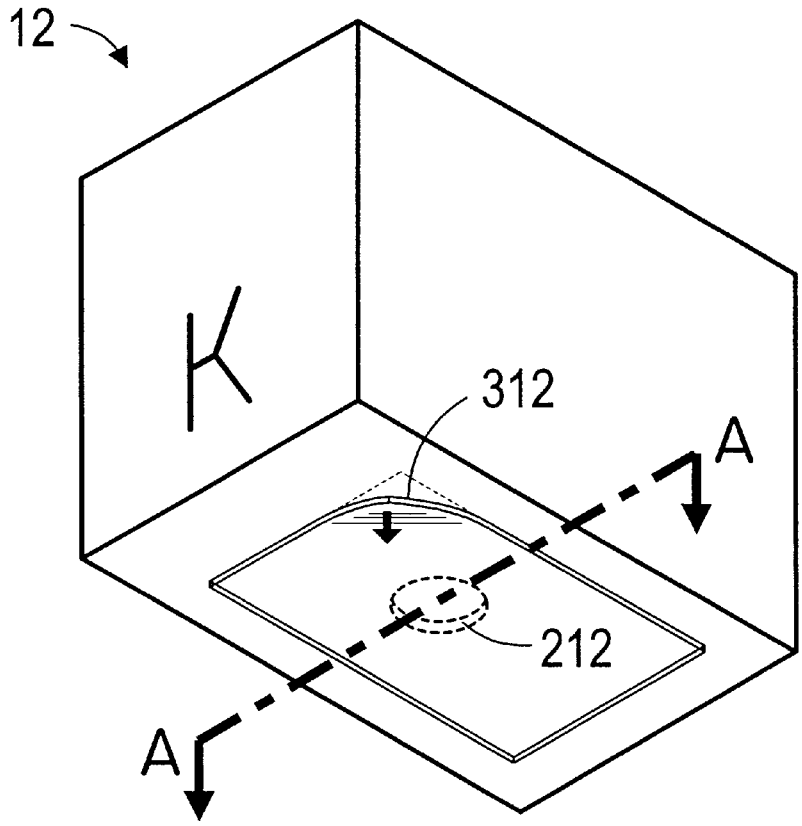
FIG. 4 a simplified representation of an exemplary replacement ink supply, illustrating how sealing tape is typically placed over the fluid interconnect.

FIG. 4 is a simplified representation of a replacement ink container 12', illustrating how a removable tape or label 312 is typically used to seal the fluid interconnect for transport and storage. Typically the seal or label is attached with a mild adhesive that permits the seal or label to be easily removed. If residual ink is present in the fluid interconnect, interaction between the ink and the adhesive can affect properties of the ink, degrading print quality. Residual ink on the back side of the label or seal can come into contact with the installer's fingers or clothes when the seal is removed from the fluid interconnect.

Figure 5:
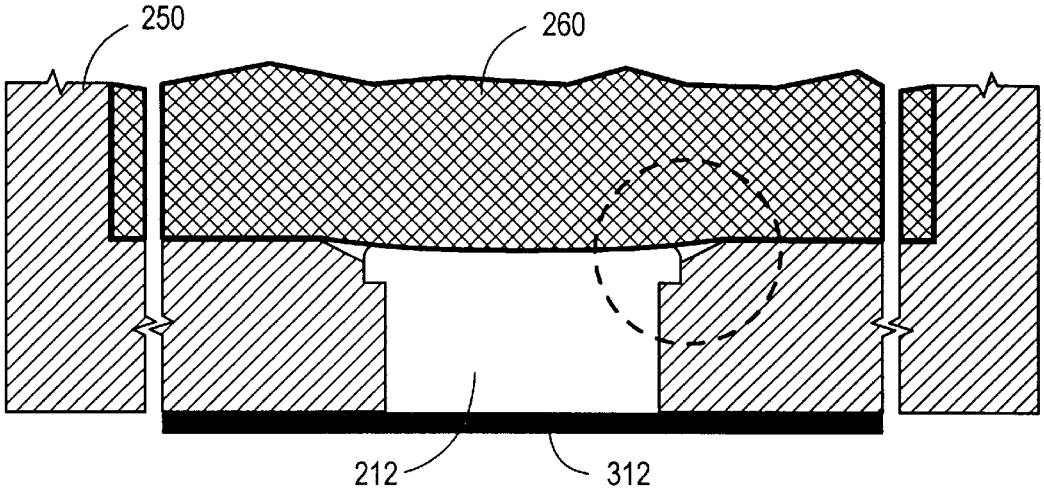
FIG. 5 is a partial view through section A—A of FIG. 4, showing the fluid interconnect region and the geometric features of the present invention.

FIG. 5 is a partial view through section A—A of FIG. 4, showing the fluid interconnect region and the geometric features of the present invention. The exemplary ink container has a rigid outer container 250 and an internal foam reservoir 260 for retaining ink. The foam reservoir may be composed of bonded polyester fiber or some other hydrophilic material that retains ink by capillary action. The geometric features of the present invention are located in the fluid interconnect port 212 near the foam reservoir, and away from the sealing tape or label 312. The features comprise an ink accumulator 252 and a capillary break 254, as better seen in FIG. 6.

Figure 6:
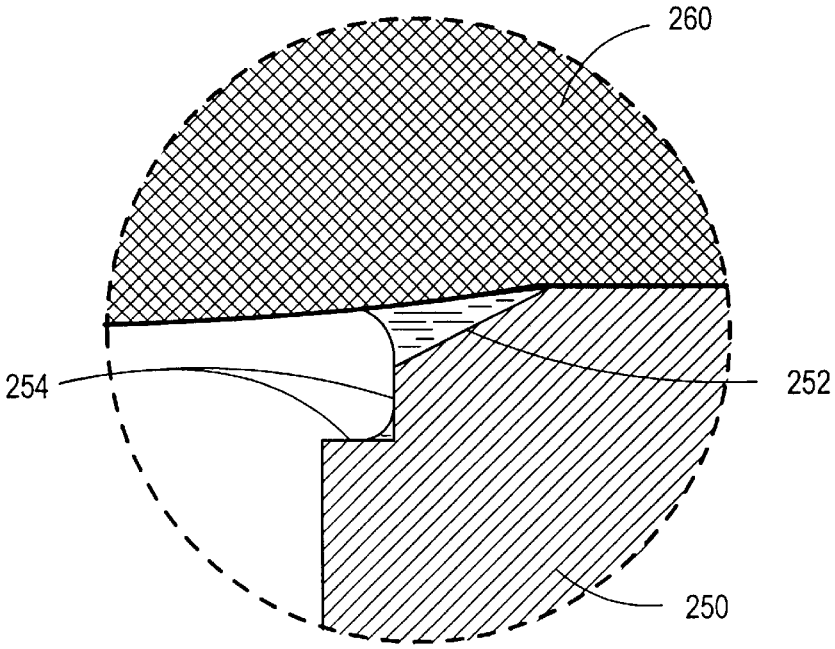
FIG. 6 is an enlarged view of a portion of FIG. 5, further illustrating the geometric features of the present invention.

FIG. 6 is an enlarged view of a portion of FIG. 5, further illustrating the geometric features of the present invention. The capillary accumulator 252 comprises a chamfer on the walls of the fluid interconnect The chamfer forms a small contact angle between the foam reservoir 260 and the supply body 250. This angle provides a capillary force that will hold a quantity of ink in contact with the foam reservoir. The capillary force also acts over time to speed up the process of driving the residual ink out of the fluid connect area and back into the foam reservoir.

The capillary break 254 is a counter bore on the inside of the plastic body around the fluid interconnect region. This capillary break works by capturing excess ink in the inside corner of the counter bore. Any ink that crosses into the FI region across the body/foam interface travels down the vertical wall of the break. If there is not an excessive amount of ink it will gather in the annular ring of the corner formed by the counterbore, which has a higher capillary force than the flat surfaces. For the ink to travel across the flat surface of the counter bore it would have to be of sufficient quantity to overcome the capillarity force of the corner to flow into the fluid interconnect region and come in contact with the label.

An advantage of the capillary break/accumulator that it permits rapid filling of the ink container while holding residual ink away from the fluid interconnect region. A further advantage is that it provides the supply with an area to store ink that could come out of the foam reservoir over time due to altitude excursions, dropping, or shipping. This ability to store ink from environmental/stress events keeps ink away from the fluid interconnect label or seal.

Figure 7:
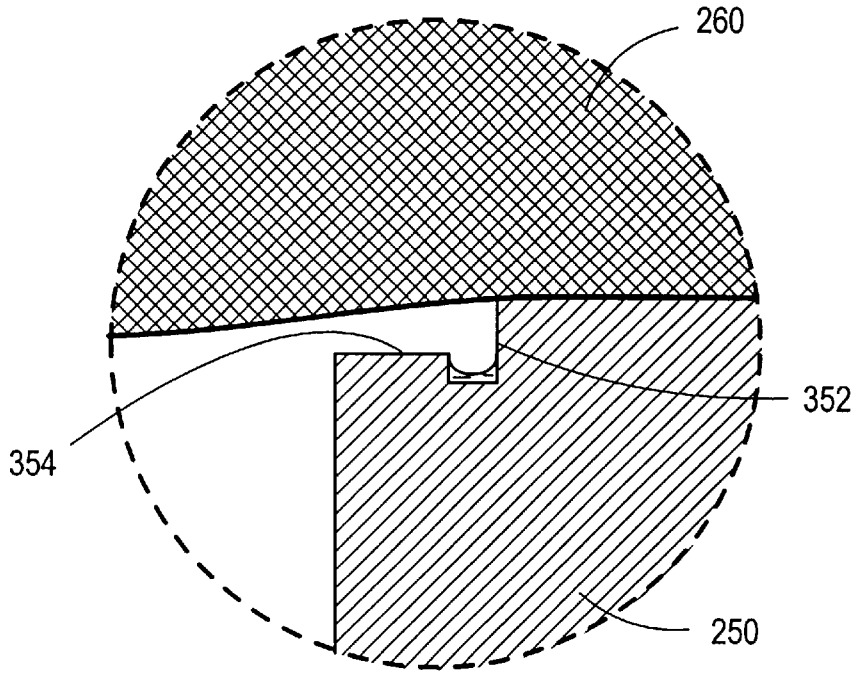
FIG. 7 is an enlarged view of an alternate embodiment of the geometric features of the present invention.
Figure 8:
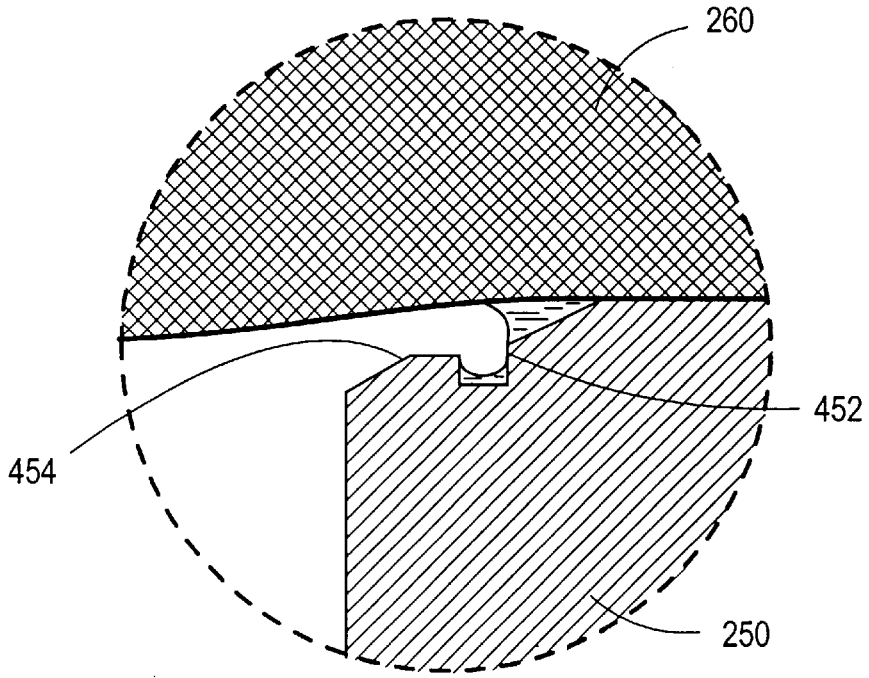
FIG. 8 is an enlarged view of a second alternate embodiment of the geometric features of the present invention.

FIGS. 7 and 8 are enlarged views of alternate embodiments of the present invention. In the embodiment shown in FIG. 7, the capillary accumulator 352 comprises a trough and the capillary break 354 comprises a flat surface. In the embodiment shown in FIG. 8, the capillary accumulator 452 comprises both a chamfer and a trough, and the capillary break 454 comprises a compound surface. The capillary accumulator and capillary break may also be used in conjunction with other features to control ink in the vicinity of the fluid port, such as surface texturing or the application of hydrophilic or hydrophobic materials. Many other combinations of capillary breaks and capillary accumulators would be apparent to one skilled in the art.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

What is claimed is:

1. In an ink reservoir having an exterior wall and a hollow interior configured to contain ink-permeable foam, a fluid interconnect port comprising:

a hole formed through the exterior wall into the hollow interior, the hole having an inside surface;

the inside surface of the hole contiguous to the hollow interior forming a capillary accumulator; and the inside surface of the hole immediately adjacent to the capillary accumulator forming capillary break.

2. The fluid interconnect port of claim 1, wherein the capillary accumulator is a chamfer formed on the inside surface of the hole.

3. The fluid interconnect port of claim 1, wherein the capillary accumulator is a trough formed in the inside surface of the hole.

4. The fluid interconnect port of claim 1, wherein the capillary break is a flat counterbore on the inside surface of the hole.

5. The fluid interconnect port of claim 1, wherein the capillary break comprises a plurality of capillary break features.

6. In an ink reservoir having an exterior wall and a hollow interior configured to contain ink-permeable foam, a fluid interconnect port comprising:

a hole formed through the exterior wall into the hollow interior, the hole having an inside surface;

means on the inside surface of the hole contiguous to the hollow interior to accumulate ink by capillary attraction; and capillary break means on the inside surface of the hole immediately adjacent to the means to accumulate ink by capillary attraction.

7. An ink reservoir, comprising:

an exterior wall and a hollow interior, the hollow interior containing ink-permeable foam;

a fluid interconnect port comprising a hole formed through the exterior wall into the hollow interior, the hole having an inside surface;

the inside surface of the hole contiguous to the hollow interior forming a capillary accumulator; and the inside surface of the hole immediately adjacent to the capillary accumulator forming a capillary break.

8. The ink reservoir of claim 7, wherein the capillary accumulator is a chamfer formed on the inside surface of the hole.

9. The ink reservoir of claim 7, wherein the capillary accumulator is a trough formed in the inside surface of the hole.

10. The ink reservoir of claim 7, wherein the capillary accumulator comprises a plurality of capillary accumulator features.

11. The ink reservoir of claim 7, wherein the capillary break is a flat counterbore on the inside surface of the hole.

12. The ink reservoir of claim 7, wherein the capillary break comprises a plurality of capillary break features.

13. The ink reservoir of claim 7, wherein the ink-permeable foam comprises bonded polyester fiber.

14. The ink reservoir of claim 7, further comprising a user-removable tape placed on the exterior wall of the reservoir and covering the fluid interconnect port.

15. In the art of ink jet printing, a method of preventing ink from contaminating the fingers or clothing of an ink reservoir installer during the installation process, the ink reservoir having an exterior wail and a hollow interior, the hollow interior containing ink-permeable foam; the reservoir further having a fluid interconnect port forming a hole through exterior wail to the hollow interior, the interconnect port sealed during shipping and storage with a removable tape, comprising the steps of:

configuring the fluid interconnect port contiguous to the hollow interior to form a capillary accumulator; and configuring the fluid interconnect port immediately adjacent to the capillary accumulator to form a capillary break.

16. The method of preventing ink from contaminating the fingers or clothing of an ink reservoir installer during the installation process of claim 15, wherein the capillary accumulator is a chamfer formed on the inside surface of the hole.

17. The method of preventing ink from contaminating the fingers or clothing of an ink reservoir installer during the installation process of claim 15, wherein the capillary accumulator is a trough formed in the inside surface of the hole.

18. The method of preventing ink from contaminating the fingers or clothing of an ink reservoir installer during the installation process of claim 15, wherein the capillary accumulator comprises a plurality of capillary accumulator features.

19. The method of preventing ink from contaminating the fingers or clothing of an ink reservoir installer during the installation process of claim 15, wherein the capillary break is a flat counterbore on the inside surface of the hole.

20. The method of preventing ink from contaminating the fingers or clothing of an ink reservoir installer during the installation process of claim 15, wherein the capillary break comprises a plurality of capillary break features.

* * * * *

UNITED STATES PATENT AND TRADEMARK OFFICE

CERTIFICATE OF CORRECTION

PATENT NO. : 6,655,792 B2
DATED : December 2, 2003
INVENTOR(S) : Benson et al.

It is certified that error appears in the above-identified patent and that said Letters Patent is hereby corrected as shown below:

Column 6,
Line 9, delete “wail” and insert in lieu thereof -- wall --;
Line 12, delete “wail” and insert in lieu thereof -- wall --.

Signed and Sealed this

Thirty-first Day of August, 2004

JON W. DUDAS
*Director of the United States Patent and Trademark Office*